US007267595B1

(12) United States Patent
Hall

(10) Patent No.: US 7,267,595 B1
(45) Date of Patent: Sep. 11, 2007

(54) SWIMMER'S PADDLE

(76) Inventor: Stephen John Hall, 17335 29th Avenue, Surrey (CA) V3S 0E8

( * ) Notice: Subject to any disclaimer, the term of this patent is extended or adjusted under 35 U.S.C. 154(b) by 0 days.

(21) Appl. No.: 11/420,269

(22) Filed: May 25, 2006

(51) Int. Cl.
*A63B 31/10* (2006.01)

(52) U.S. Cl. ..... 441/56

(58) Field of Classification Search ..... 441/56, 441/58; D21/806
See application file for complete search history.

(56) References Cited

U.S. PATENT DOCUMENTS

| | | | | |
|---|---|---|---|---|
| 2,159,972 | A * | 5/1939 | Arvid | 441/58 |
| 3,397,414 | A * | 8/1968 | Webb | 441/56 |
| RE28,855 | E | 6/1976 | Montrella | |
| 4,316,300 | A | 2/1982 | Lewis | |
| 4,746,313 | A | 5/1988 | Bray et al. | |
| 4,832,643 | A | 5/1989 | Schoofs | |
| 4,913,418 | A | 4/1990 | Schlueter et al. | |
| 5,288,254 | A | 2/1994 | Elson | |
| 5,304,080 | A | 4/1994 | Dilger | |
| 5,376,036 | A | 12/1994 | Hull | |
| D363,754 | S | 10/1995 | Johnson | |
| 5,511,998 | A | 4/1996 | Johnson | |
| 5,516,319 | A | 5/1996 | Nessel | |
| 5,549,294 | A | 8/1996 | Wellen et al. | |
| D378,307 | S | 3/1997 | Desveaux | |
| 5,643,027 | A | 7/1997 | Evans et al. | |
| 5,647,783 | A | 7/1997 | Nessel | |
| 5,651,710 | A | 7/1997 | Rives et al. | |
| 5,658,224 | A | 8/1997 | Betrock | |
| D397,187 | S | 8/1998 | Reeder | |
| 5,842,896 | A | 12/1998 | Liveoak | |
| 6,019,650 | A | 2/2000 | Rives et al. | |
| 6,685,521 | B1 | 2/2004 | Melius | |
| 6,899,581 | B1 | 5/2005 | Nokes | |
| 2004/0203301 | A1 | 10/2004 | Johnson | |
| 2005/0026518 | A1 | 2/2005 | Bolster | |

* cited by examiner

*Primary Examiner*—Ed Swinehart

(57) ABSTRACT

According to the present invention there is provided a swimmer's paddle for attachment to the hand of a swimmer. The paddle includes a body member having an upper surface and a lower surface, a front edge adjacent the fingertips of a swimmer, a rear edge adjacent the palm, an inner edge adjacent the thumb and an outer edge adjacent the little finger. When the fingers rest on the upper surface of the body member they are substantially aligned in a first plane. The paddle also includes a device connected to the body member for positioning the thumb on the body member in a second plane below the fingers, and a device connected to the body member for holding the body member from movement away from the thumb during a swimmer's stroke.

19 Claims, 5 Drawing Sheets

SWIMMER'S PADDLE

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

The invention relates to the field of swimming and in particular to a paddle for attachment to a swimmer's hand.

BACKGROUND OF THE INVENTION

A competitive swimmer's performance can be improved in two basic ways, by perfecting technique and by building strength. Improvement of the arm portion of a swimming stroke, as separated from the kick portion of the stroke, has in the past been pursued with the use of swim paddles fitted to the swimmer's hands. Such swim paddles are conventionally releasably attached to the swimmer's hands, and are used to increase the drag to which the swimmer is exposed while swimming. As such, these devices tend to be much more effective at building arm strength than at promoting the perfection of technique.

Existing swim paddles are available in a variety of shapes and forms, some being flat in a square configuration, some flat in a rectangular configuration, some oval, some triangular and some flat in a combination of geometric configurations. As well as being available in various flat configurations, swim paddles are also available in a curved or cupped form with the intention of providing greater resistance, improved technique or both. Swim paddles are typically attached to the hands of the swimmer by surgical tubing or other strap-like elastomeric device positioned through the paddle to form a finger loop. It is often the case that a further such loop or more is employed to secure the swimmers wrist or other parts of the hand to the paddle in a similar manner. Further, some paddles designs are such that the swimmer must extend his fingers over the edge of the paddle resulting in an unnatural hand position in order to securely grasp the paddle. Examples of existing paddles are shown in U.S. Pat. Nos. 4,913,418; 5,288,254; 5,376,036; and 5,643,027. It is clear therefore that with the many forms of paddle available to the swimmer, each will perform somewhat differently according to his level of expertise, quality of technique, effort and expectations.

A common observation, however, is that the usual method of attaching a paddle to the hand does not provide paddle stability during a swimmer's stroke nor encourage proper swim technique. The prior art is replete with examples of paddles secured to the hand or fingers with a mere strap which causes paddle instability during a swimmer's stroke. During the front crawl stroke, for example, the trailing hand begins an upward movement prior to leaving the water to begin its forward propulsive stroke. It is at this point that water pressure is actually on the top or upper part of the paddle thus causing the paddle to move away from the hand resulting in both perceived and actual instability. When the paddle is fitted with a series of fastenings, rather than move away from the hand, the paddle tends to wobble sideways, again resulting in both perceived and actual instability. Some designs have attempted to overcome these conditions by encouraging the swimmer to grasp the edges of the paddle with the fingertips. The obvious disadvantage with this approach is that it does not encourage the correct technique with the swimmer and its degree of success is very much dependent on the size of the swimmers hands. Finally, the prior art is also replete with examples of paddles which force a swimmer to place the fingers and thumb in a single plane along the upper or top surface of the paddle which discourages proper swim technique.

Accordingly, there is a need for a paddle that provides for improved hand positioning on the paddle and proper hand form during each stroke as well as providing increased resistance and improved muscle development. Other objects of the invention will be apparent from the description that follows.

SUMMARY OF THE INVENTION

According to the present invention there is provided a swimmer's paddle for attachment to the hand of a swimmer. The paddle includes a body member having an upper surface and a lower surface, a front edge adjacent the fingertips of a swimmer, a rear edge adjacent the palm, an inner edge adjacent the thumb and an outer edge adjacent the little finger. When the fingers rest on the upper surface of the body member they are substantially aligned in a first plane. The paddle also includes a device connected to the body member for positioning the thumb on the body member in a second plane below the fingers, and a device connected to the body member for holding the body member from movement away from the thumb during a swimmer's stroke.

The device for positioning the thumb in the second plane may be an aperture defined by the body member from the upper surface to the lower surface, whereby the thumb can protrude from the upper surface to the lower surface. Alternatively, the device may be a stepped lower member connected to the body member.

The body member adjacent the aperture may be shaped to cup the thumb portion of the palm.

The device for holding the body member from movement away from the thumb may be a thumb cover member which may be shaped is snugly receive the thumb and may be integrally formed with the body member The swim may further include a device connected to the body member for restraining at least one finger against the upper surface of the body member. The device may be a finger-securing loop which may be inserted through a perforation in the body member. The finger-securing loop may be comprised of a resilient material such as an elastomer and may have a cross section larger than the diameter of the perforation so that it must be stretched in order to pass through the perforation.

Other aspects of the invention will be appreciated by reference to the detailed description of the preferred embodiment and to the claims that follow.

BRIEF DESCRIPTION OF THE DRAWINGS

The preferred embodiment of the invention will be described by reference to the drawings thereof in which.

DESCRIPTION OF THE PREFERRED EMBODIMENT OF THE INVENTION

Figure 1:
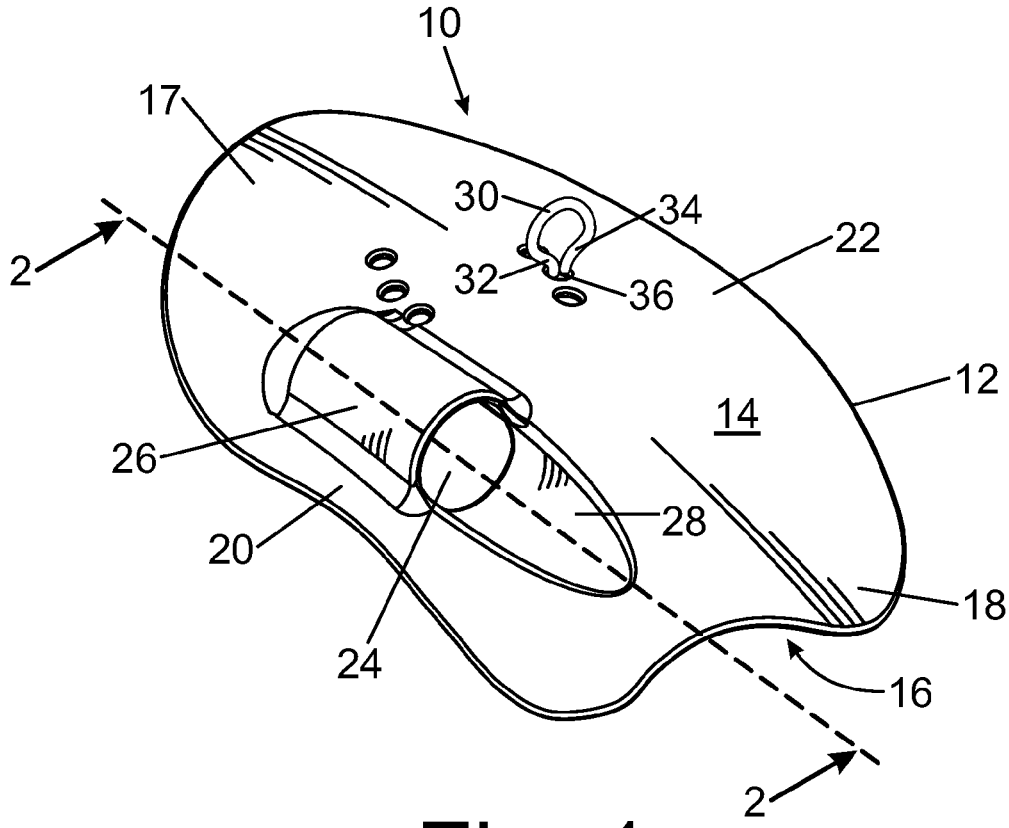
FIG. 1 is a top perspective view of the swimmer's paddle in accordance with the present invention.

Referring to the FIG. 1, swim paddle 10 of the present invention is illustrated which includes a rigid main body member 12 having an upper surface 14 and a corresponding lower surface 16. Preferably, upper surface 14 is convex and lower surface 16 is correspondingly concave. The paddle 10 also has a front edge 17, a rear edge 18, an inner edge 20 and an outer edge 22.

Body member 12 of the paddle 10 is preferably designed to have an air foil shape along both its length and width dimensions. Body member 12 can be constructed of a thermoplastic resin having suitable impact resistance and good formability. Alternatively, other materials having good formability combined with adequate stiffness could also be used. The thickness of body member 12 is preferably approximately 2 mm-3 mm.

Figure 5:
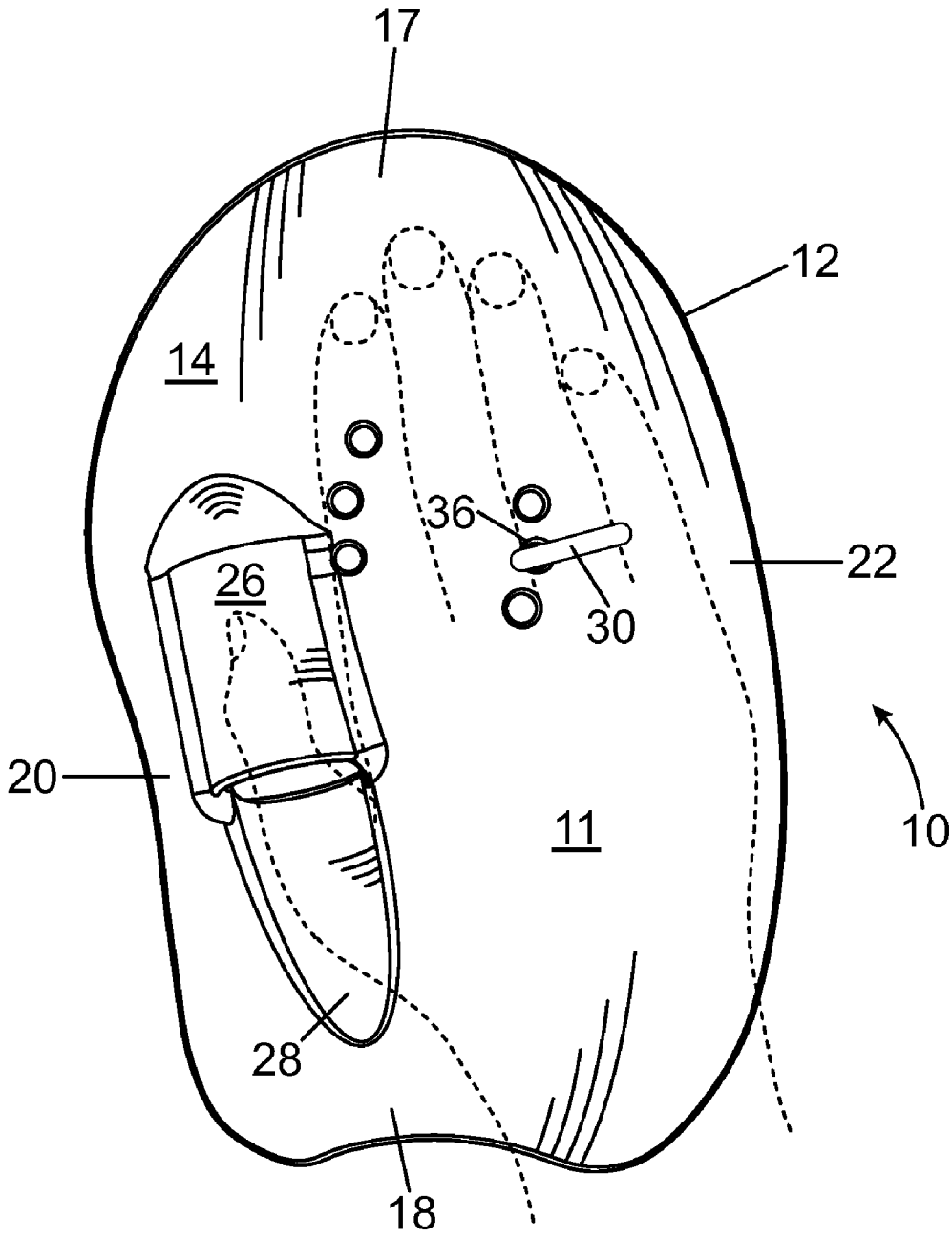
FIG. 5 is a top plan view of the swimmer's paddle of FIG. 1.
Figure 6:
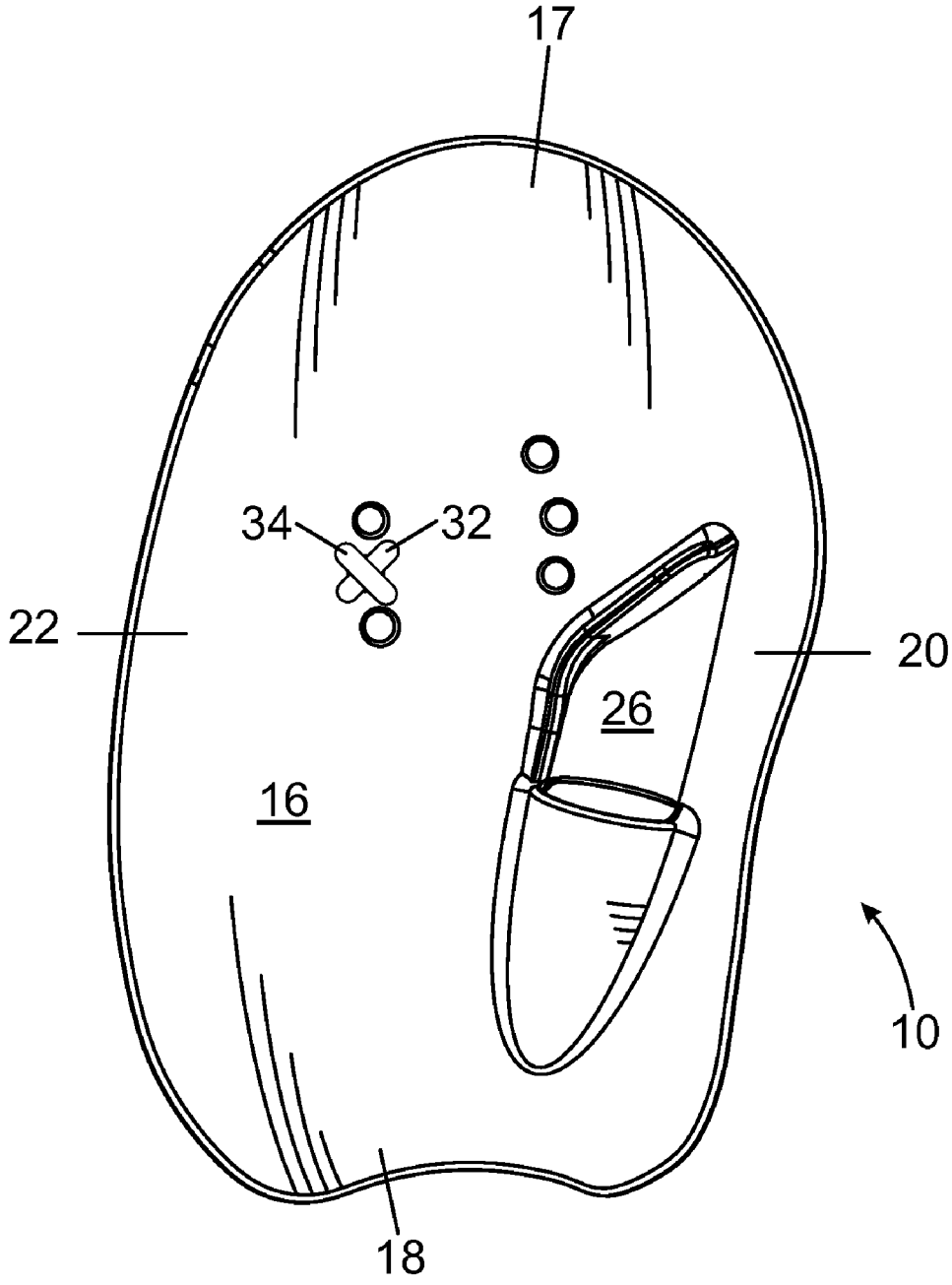
FIG. 6 is a bottom plan view of the swimmers paddle of FIG. 1.

Referring to FIG. 5, the overall size of body member 12 conforms roughly with the size of a person's hand 11 with the front edge 17 adjacent to the tips of the person's fingers, the rear edge 18 adjacent to the palm of the person's hand, the inner edge 20 adjacent to the thumb of the person's hand and the outer edge 22 adjacent to the little finger of the person's hand. When the paddle is fitted to the hand of the swimmer, the fingers are substantially aligned in a first plane upon upper convex surface 14. As a swimmer's performance improves he or she may graduate to larger paddles of relative dimensions in order to increase the training resistance and therefore overall performance.

Figure 2:
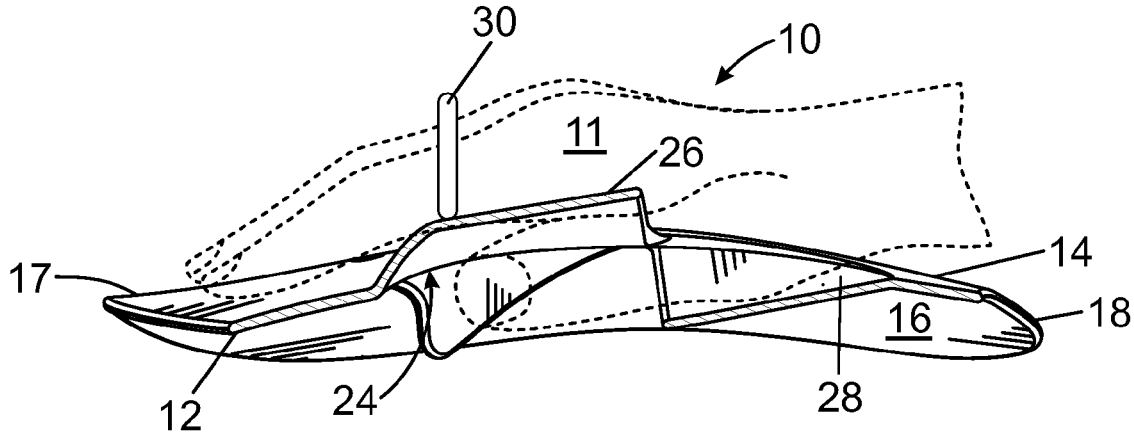
FIG. 2. is a cut-away view along line 2-2 of FIG. 1.
Figure 3:
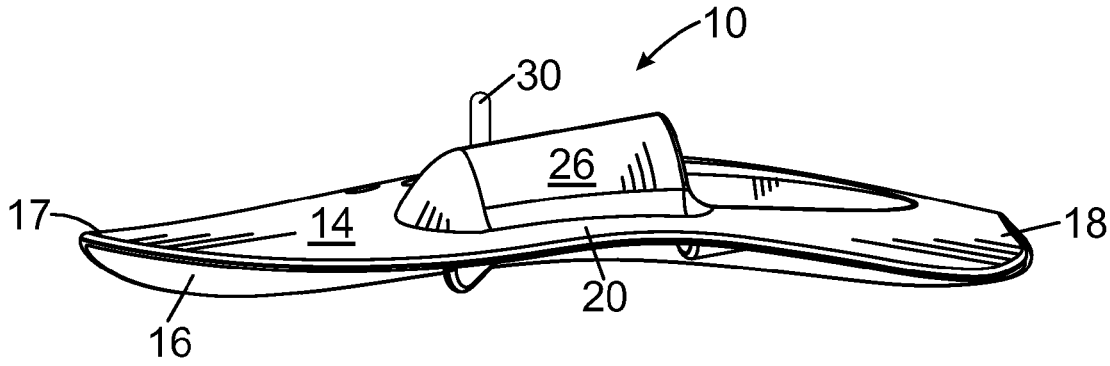
FIG. 3. is a left side elevation of the swimmer's paddle of FIG. 1.
Figure 4:
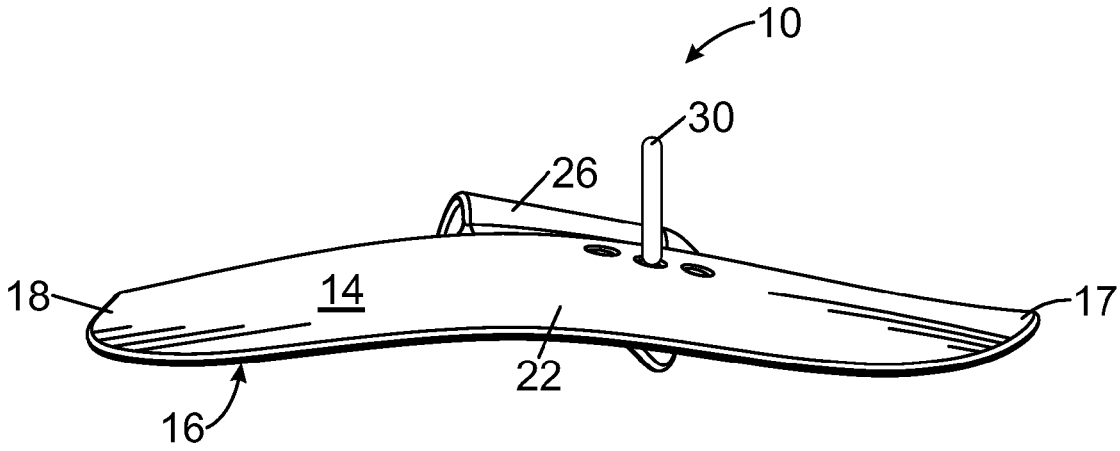
FIG. 4 is a right side elevation of the swimmer's paddle of FIG. 1.
Figure 7:
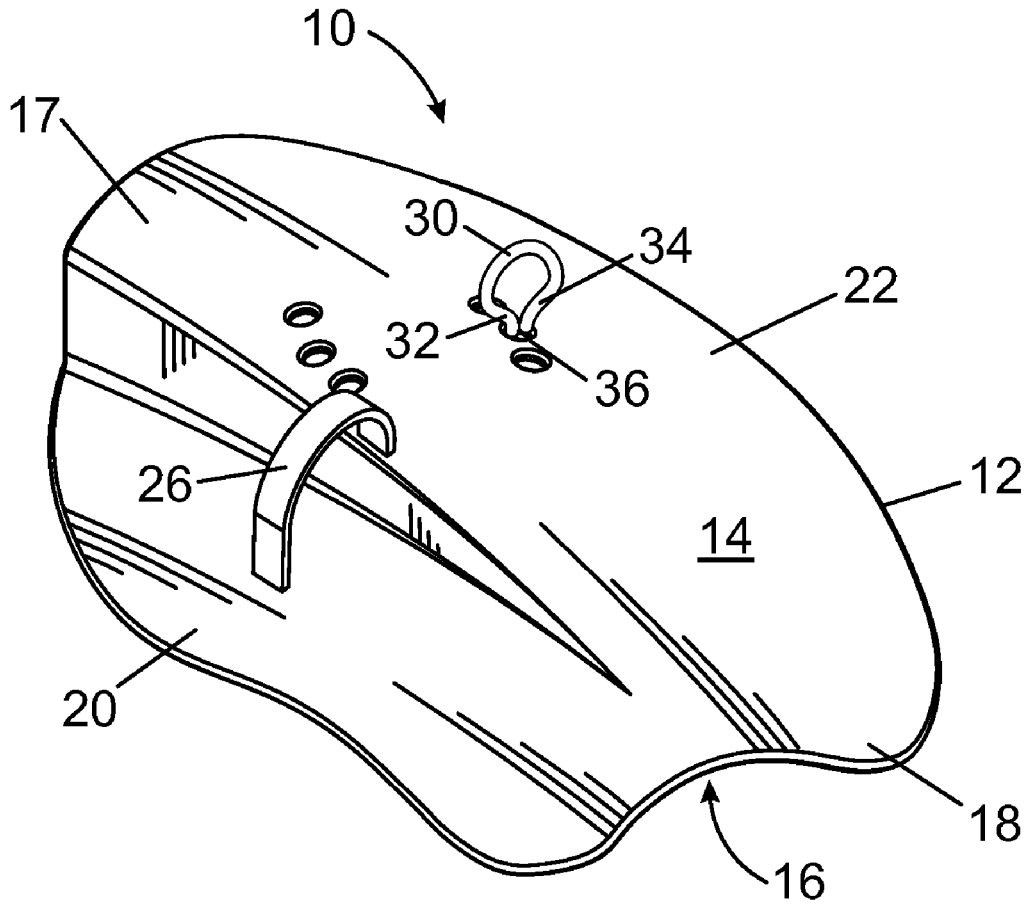
FIG. 7 is an alternative embodiment of the swimmer's paddle of FIG. 1.

To allow for proper hand technique during the swimmer's stroke, swim paddle 10 also includes means connected to body member 12 for positioning the thumb on the body member in a second plane below the fingers. Referring to FIG. 7, such means may include a stepped lower member 100 connected to body member 12. Stepped member 100 may be integrally formed with body member 12 and shaped to receive the swimmer's thumb and the thumb portion of the palm. Referring to FIGS. 1 and 2, preferably, an aperture 24 from the upper convex surface 14 to the lower concave surface 16 is used to allow the thumb to protrude through the body member 12 and position itself in the second plane. Hence, unlike conventional paddles where the thumb and fingers are aligned in the same plane, swim paddle 10 of the present invention positions the thumb below the fingers which encourages proper hand form during a swimmer's stroke.

Swim paddle 10 also includes means connected to body member 12 for holding the body member from movement away from the thumb during a swimmer's stroke. For example, a conventional strap or loop connected to body member 12 may be used. Preferably, swim paddle 10 includes a thumb cover member 26 connected to body member 12 above the aperture 24. Thumb cover member 26 may by shaped to snugly receive the thumb and may be integrally formed with body member 12. Rather than attaching the swim paddle 10 to the swimmer's hand by merely using a strap to hold down a finger, it is desirable to utilize the thumb as the thumb is the strongest digit on the hand and can more easily overcome the water pressure subjected on the paddle during a swimmer's stroke.

To provide a better fit in the thumb region of the palm, swim paddle 10 may be shaped to provide a divot 28 by aperture 24 to cup the thumb portion of the palm. The divot 28 may simply be formed in body member 12 during fabrication.

To provide additional connection of a swimmer's hand 11 to paddle 10, the paddle may include means connected to body member 12 for restraining at least one finger against the upper surface of 14 the body member. For example, a finger cover member much like thumb cover member 26 may be employed (not illustrated). Referring to FIGS. 1 and 5, preferably, an adjustable finger securing-loop 30 extending from the upper surface 14 of the paddle 10 is used to releasably attach a swimmer's finger to body member 12. The finger-securing loop may be an elongated strap having a first end 32 and a second end 34. At least one perforation 36 is formed through body member 12 at a location centrally located across the width of body member 12. First 32 and second ends 34 may then be inserted through perforation 36 to secure loop 30 to body member 12 by any conventional means, for examples, by knotting first 32 and second 34 ends together or individually. It will be apparent to those skilled in the art that finger-securing loop 30 may releasably attach one or more fingers and one or more perforations may be used to customize the fit of securing loop 30 over one or more fingers. It is also contemplated that more than one finger-securing loop 30 may be used to more securely attach body member 12 to the swimmer's hand 11. Additionally, finger-securing loop 30 may be comprised of a resilient material such as an elastomer. With a resilient finger-securing loop 30 having a cross section larger than the diameter of perforation 36, finger-securing loop 30 may then be stretched in order to pass through the perforation 36.

OPERATION

To fit paddle 10 onto hand 11, the thumb is inserted through aperture 24 and at least one finger is secured by finger-securing loop 30 so that the palm of the hand rests on the upper convex surface 14. Depending upon the swimmer's needs, finger-securing loop 30 may be attached to one or more fingers. Additionally, finger-securing loop 30 may be inserted through one or more perforations 36 to customize the fit of body member 12 to the palm of hand 11.

By positioning the thumb at a lower plane than the fingers, paddle 10 encourages proper hand technique during the swimmer's stroke. Additionally, because the thumb cover 26 holds body member 12 from movement away from the thumb during a swimmer's stroke, swim paddle 10 reduces any perceived or actual instability during a swimmer's stroke further resulting in proper stroke technique.

It will thus be seen that a new and novel swimmer's paddle has been illustrated and described and it will be apparent to those skilled in the art that various changes and modifications may be made therein without departing from the spirit of the invention.

What is claimed is:

1. A swimmer's paddle for attachment to the hand of a swimmer, the hand having a palm and fingers and a thumb extending therefrom, the paddle comprising:

a body member having an upper surface and a lower surface, a front edge adjacent the fingertips, a rear edge adjacent the palm, an inner edge adjacent the thumb and an outer edge adjacent the little finger, whereby the fingers when resting on said upper surface are substantially aligned in a first plane, wherein said body member defines an aperture from said upper surface to said lower surface, whereby the thumb can protrude from said upper surface to said lower surface in a second plane below the fingers, and wherein said body member adjacent said aperture is shaped to cup the thumb portion of the palm; and means connected to said body member for holding said body member from movement away from the thumb during a swimmer's stroke.

2. The swim paddle of claim 1 wherein said means for holding the body member from movement away from the thumb comprises a thumb cover member.

3. The swim paddle of claim 2 wherein said thumb cover member is shaped to snugly receive the thumb.

4. The swim paddle of claim 2 wherein said body and thumb cover members comprise a unitary rigid structure.

5. The swim paddle of claim 1 further comprising means connected to said body member for restraining at least one finger against said upper surface of said body member.

6. The swim paddle of claim 5 wherein said means for restraining at least one finger comprises a finger-securing loop.

7. The swim paddle of claim 6 wherein said body member defines at least one perforation adjacent said at least one finger.

8. The swim paddle of claim 7 wherein said finger-securing loop is connected to said body member through said at least one perforation.

9. The swim paddle of claim 8 wherein said finger-securing loop is comprised of a resilient material.

10. The swim paddle of claim 9 wherein said resilient material is comprised of an elastomer.

11. The swim paddle of claim 9 wherein said finger-securing loop has a cross section larger than the diameter of said at least one perforation so that said loop must be stretched in order to pass through said at least one perforation.

12. A swimmer's paddle for attachment to the hand of a swimmer, the hand having a palm and fingers and a thumb extending therefrom, the paddle comprising:

a body member having an upper surface and a lower surface, a front edge adjacent the fingertips, a rear edge adjacent the palm, an inner edge adjacent the thumb and an outer edge adjacent the little finger, whereby the fingers when resting on said upper surface are substantially aligned in a first plane, wherein said body member defines an aperture from said upper surface to said lower surface, whereby the thumb can protrude from said upper surface to said lower surface in a second plane below the fingers;

a thumb cover member connected to said body member over said aperture to hold said body member from movement away from the thumb during a swimmer's stroke; and a finger-securing loop connected to said body member for restraining at least one finger against said upper surface of said body member.

13. The swim paddle of claim 12 wherein said body member adjacent said aperture is shaped to cup the thumb portion of the palm.

14. The swim paddle of claim 12 wherein said body and thumb cover members comprise a unitary rigid structure.

15. The swim paddle of claim 12 wherein said body member defines at least one perforation adjacent said at least one finger.

16. The swim paddle of claim 15 wherein said finger-securing loop is connected to said body member through said at least one perforation.

17. The swim paddle of claim 16 wherein said finger-securing loop is comprised of a resilient material.

18. The swim paddle of claim 17 wherein said resilient material is comprised of an elastomer.

19. The swim paddle of claim 17 wherein said finger-securing loop has a cross section larger than the diameter of said at least one perforation so that said loop must be stretched in order to pass through said at least one perforation.

* * * * *